US008317426B2

(12) United States Patent
Steffen

(10) Patent No.: US 8,317,426 B2
(45) Date of Patent: Nov. 27, 2012

(54) SOIL COMPACTING DEVICE

(75) Inventor: Michael Steffen, Munich (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 84 days.

(21) Appl. No.: 12/997,733

(22) PCT Filed: Jan. 12, 2010

(86) PCT No.: PCT/EP2010/000108

§ 371 (c)(1),
(2), (4) Date: Dec. 13, 2010

(87) PCT Pub. No.: WO2010/081674

PCT Pub. Date: Jul. 22, 2010

(65) Prior Publication Data

US 2011/0097149 A1 Apr. 28, 2011

(30) Foreign Application Priority Data

Jan. 13, 2009 (DE) ..... 10 2009 004 443

(51) Int. Cl.
*E01C 19/35* (2006.01)

(52) U.S. Cl. ..... 404/133.1; 404/133.05

(58) Field of Classification Search ... 404/133.05–133.2
See application file for complete search history.

(56) References Cited

U.S. PATENT DOCUMENTS 3,162,102 A * 12/1964 Juneau ..... 404/133.1
3,538,821 A * 11/1970 Waschulewski et al. .. 404/133.1
3,756,735 A * 9/1973 Linz ..... 404/133.05
3,856,426 A * 12/1974 Waschulewski et al. .. 404/133.1
5,340,233 A * 8/1994 Motl ..... 404/133.05
6,443,651 B1 * 9/2002 Greppmair ..... 404/133.05
6,749,365 B2 * 6/2004 Sina et al. ..... 404/133.1
7,354,221 B2 * 4/2008 Congdon ..... 404/84.1
7,520,351 B2 * 4/2009 Uchisasai et al. ..... 180/65.245
7,617,894 B2 * 11/2009 Ozeki et al. ..... 180/65.21
7,682,102 B1 * 3/2010 Burke et al. ..... 404/133.1

FOREIGN PATENT DOCUMENTS

EP 1 267 001 A1 12/2002
EP 1 930 505 A1 6/2008
GB 2 455 627 A 6/2009

OTHER PUBLICATIONS

International Search Report for PCT/EP2010/000108, Dated Feb. 26, 2010.

* cited by examiner

*Primary Examiner* — Raymond W Addie

(74) *Attorney, Agent, or Firm* — Boyle Fredrickson, S.C.

(57) ABSTRACT

A tamper as a soil-compacting device having a combustion engine, a soil contact element, and a motion conversion device for converting a rotary movement of the combustion engine into an oscillating linear movement of the soil contact element. Furthermore, a clutch device for connecting and interrupting the force flow between the combustion engine and the motion conversion device is provided. In addition to the combustion engine, an electric motor with a rotor and a stator is provided, wherein the operator can switch between the combustion engine and the electric motor. The rotor can be arranged directly on a clutch bell of the clutch device.

18 Claims, 4 Drawing Sheets

SOIL COMPACTING DEVICE

BACKGROUND OF THE INVENTION

1. Field of the Invention

The present invention relates to a soil compacting device including a soil contact element that is driven to oscillate linearly by a movement conversion device. Such soil compacting devices are known and are also referred to as tampers or vibrating tampers.

2. Discussion of the Related Art

In such tampers, it is known to use either an internal combustion engine, for example a gasoline or diesel engine, or an electric drive mechanism. Internal combustion engines have the advantage that they are independent of external energy sources. However, internal combustion engines have the disadvantage of emission of exhaust gases and noise. The problem of noise or pollutant emission does not exist in the case of electric drive mechanisms. However, for these mechanisms it is necessary to provide a power network or a generator in order to enable operation of the electric motor. In addition, a mains cable is required in order to enable the tamper to be connected to the power source (mains connection). This impairs the ease of handling of electric tampers.

FIG. 1 shows a schematic side view of a known tamper.

In the upper area, an internal combustion engine 1 is situated between a guide bar 2. Internal combustion engine 1 receives fuel from a tank 3 that is attached to guide bar 2. Using guide bar 2, an operator can guide the tamper in a known manner. Underneath internal combustion engine 1, a housing 4 is provided in which there is situated a movement conversion device for converting a rotational movement of internal combustion engine 1 into an oscillating linear movement of a soil contact element 6. Movement conversion device 5 is explained in more detail below on the basis of FIG. 2. Soil contact element 6 is fashioned as a tamper foot.

FIG. 2 shows a section through housing 4.

From internal combustion engine 1, an engine shaft 7 extends vertically downward. A centrifugal clutch 8, which forms a clutch device, is placed on the conical end of engine shaft 7. Centrifugal clutch 8 is fashioned in a known manner and has a plurality of centrifugal force elements 9 that are held in a radially internal initial position by springs 10. As soon as the rotational speed of engine shaft 7 exceeds a prespecified value, centrifugal force elements 9 move outward against the action of springs 10, and thus form a positive or frictional connection between an internally situated drive bank 11 of the centrifugal clutch and an externally situated driven bank 12. Driven bank 12 is formed by a clutch bell 13.

Clutch bell 13 is part of an intermediate shaft 14 whose rotational movement is transmitted to a crank disk 15 via a bevel gear tooth system.

On crank disk 15, there is provided a crank pin 16 that drives a connecting rod 17 in a known manner. Connecting rod 17 is coupled to soil contact element 6 via an intermediate piston and spring assemblies (not shown). In this way, the movement of connecting rod 17 can be converted into the oscillating linear movement of soil contact element 6.

The design of such a tamper, and in particular of movement conversion device 5, is known and therefore need not be explained in more detail here.

SUMMARY OF THE INVENTION

The present invention is based on the object of indicating an improved soil compacting device that is superior to the devices known up to now with regard to its possible applications and its ease of handling.

According to the present invention, this object is achieved by a soil compacting device a soil compacting device has an internal combustion engine, a soil contact element, a movement conversion device for converting a rotational movement of the internal combustion engine into an oscillating linear movement of the soil contact element, and a clutch device for connecting and interrupting the flow of force between the internal combustion engine and the movement conversion device. This soil compacting device is characterized in that, in addition to the internal combustion engine, an electric motor is provided having a rotor and a stator, and in that the movement conversion device can optionally be driven by the internal combustion engine or by the electric motor.

One part of the soil compacting device thus corresponds to a classical soil compacting device having an internal combustion engine, in which a soil contact element, e.g. a tamper foot, is driven by the internal combustion engine via the movement conversion device, e.g. a crank drive, in order to carry out a tamping movement. In addition, the clutch device is provided with which the flow of force between the internal combustion engine and the movement conversion device can be interrupted or connected as needed. The clutch device can for example have a centrifugal clutch that transmits or interrupts the flow of force as a function of the rotational speed of the driving shaft (e.g. engine shaft). Thus, it is possible for tamping operation to be interrupted if the internal combustion engine rotates with a low rotational speed that is below a prespecified boundary value, e.g. a no-load rotational speed. The clutch device will connect the flow of force only when the rotational speed of the internal combustion engine increases to a level greater than the prespecified value, so that the soil contact element is driven. When the rotational speed again falls below the prespecified rotational speed value, the tamper again comes to a standstill, although the internal combustion engine can continue to be operated, e.g. with a no-load rotational speed.

In addition to the internal combustion engine, the electric motor is provided, and switching back and forth between the internal combustion engine and the electric motor can take place for example with the aid of the changeover device. Thus, depending on the particular application and the available energy, the operator can choose whether the soil compacting device is to be driven by the internal combustion engine or by the electric motor. Thus, depending on the wishes of the operator, a self-contained operation is possible, remote from any mains connection, using the internal combustion engine, or an environmentally friendly, low-emission operation using the electric motor is possible.

The changeover device can for example be automated by automatically selecting the electric motor when a mains cable is connected to the soil compacting device.

The electric motor can be connectable to a mains power network via a mains cable. Additionally or alternatively, an electrical energy storage device, e.g. a battery or an accumulator, can be provided on the soil compacting device, with the aid of which the electric motor can be supplied with power, similar to a laptop. The energy storage device can be charged via the mains cable. In a variant, the energy storage device can also be charged by the electric motor, which is then operated as a generator, the electric motor then in turn being driven by the internal combustion engine.

It is also possible for both drive motors, i.e. both the internal combustion engine and the electric motor, to be operated parallel to one another, in order in this way to provide approximately twice the drive power. However, because as a rule each of the motors should in itself be sufficiently dimensioned, this case of application is of lesser importance. Correspondingly, the changeover device can be fashioned in such a way that for example operation of the electric motor is not possible when the internal combustion engine is in operation.

The clutch device can have a drive bank that is coupled to the internal combustion engine, a driven bank coupled to the movement conversion device, and at least one clutch element that acts between the drive bank and the driven bank, the rotor of the electric motor being coupled to the driven bank of the clutch device. In this way, it is very easily possible to situate the electric motor in or near the flow of force between the internal combustion engine and the movement conversion device, in order to keep the constructive outlay small for the additional integration of the electric motor. Optionally, the internal combustion engine can drive the driven bank via the clutch device, or the electric motor can load the driven bank via its rotor.

The driven bank of the clutch device then forwards the drive energy to the movement conversion device in order to move the soil contact element in the desired manner. The rotor can form a constructive unit together with the driven bank of the clutch device. In this way, the rotor can be provided directly on the driven bank. Likewise, the driven bank can form the rotor of the electric motor.

In a variant, a toothing is fashioned on the driven bank of the clutch device, the rotor of the electric motor being coupled to a pinion that meshes with the toothing of the driven bank. In this alternative, for example a centrifugal clutch bell that forms the driven bank of the clutch device can be fashioned with an outer toothing in which the pinion of the electric motor, which is then provided separately, engages. This solution makes it possible to operate the motor with a significantly higher rotational speed, resulting in a smaller constructive size and higher efficiency. However, an additional outlay must be made for the separate mounting of the motor shaft and the toothing.

The clutch device can be a centrifugal clutch device for connecting and interrupting the flow of force between the internal combustion engine and the movement conversion device as a function of a rotational speed of the internal combustion engine. This was already explained above.

It is possible for the clutch element to be a centrifugal element. In centrifugal clutch devices, it is standard for one or more centrifugal elements to move radially outward, against the action of a spring or some other retaining forces, as a function of the drive rotational speed when a prespecified boundary rotational speed is exceeded, and in this way to create a frictional or positive connection between the drive bank and the driven bank of the clutch. Centrifugal clutches are known, so that no further explanation is required here.

The drive bank can be coupled to an engine shaft of the internal combustion engine. In this way it is for example possible for the clutch device to be placed directly on the engine shaft, in order to do away with the need for additional components or clutch devices.

The driven bank can be fashioned as a clutch bell, the rotor being capable of being fashioned on the outer circumference of the clutch bell. Centrifugal clutches often have such a clutch bell that surrounds the centrifugal element or the plurality of centrifugal elements and the drive bank in the manner of a bell. The clutch bell then represents the driven bank. Because the clutch bell is in most cases rotationally symmetrical, it is particularly easy to place the rotor of the electric motor on the outside of the clutch bell, to fashion it on the outside of the clutch bell, or to integrate it into the clutch bell.

Correspondingly, the stator can be provided in a housing surrounding the clutch device. In this way, it is not necessary to provide a separate housing for the electric motor, which would increase the constructive expense and the weight of the device. Rather, it is possible to integrate the stator directly into the housing that is already present anyway and that surrounds the clutch device.

In another specific embodiment, the movement conversion device can have a toothing and the electric motor can have a pinion that meshes with the toothing of the movement conversion device. Thus, for example, it is possible for the electric motor to drive a bevel gear pinion that engages in the toothing of a bevel gear of the crank drive that belongs to the movement conversion device.

The soil compacting device can be a tamper for soil compacting, the movement conversion device having a crank drive and the soil contact element being a tamper foot.

These and additional advantages and features are explained in more detail below on the basis of an example with the aid of the accompanying Figures.

DETAILED DESCRIPTION OF THE PREFERRED EMBODIMENTS

Figure 1:
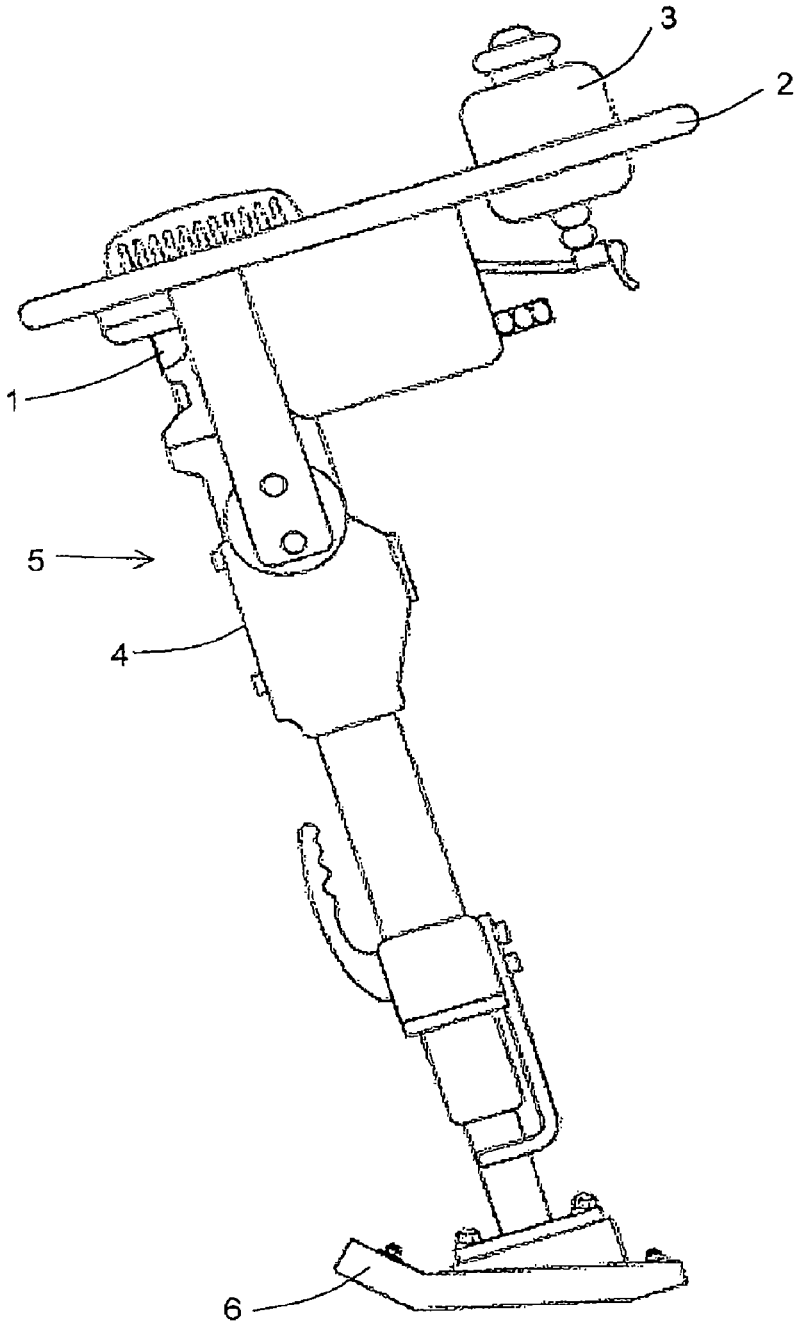
Fig. 1 PRIOR ART
FIG. 1 shows a known tamper as a soil compacting device, in a side view.
Figure 2:
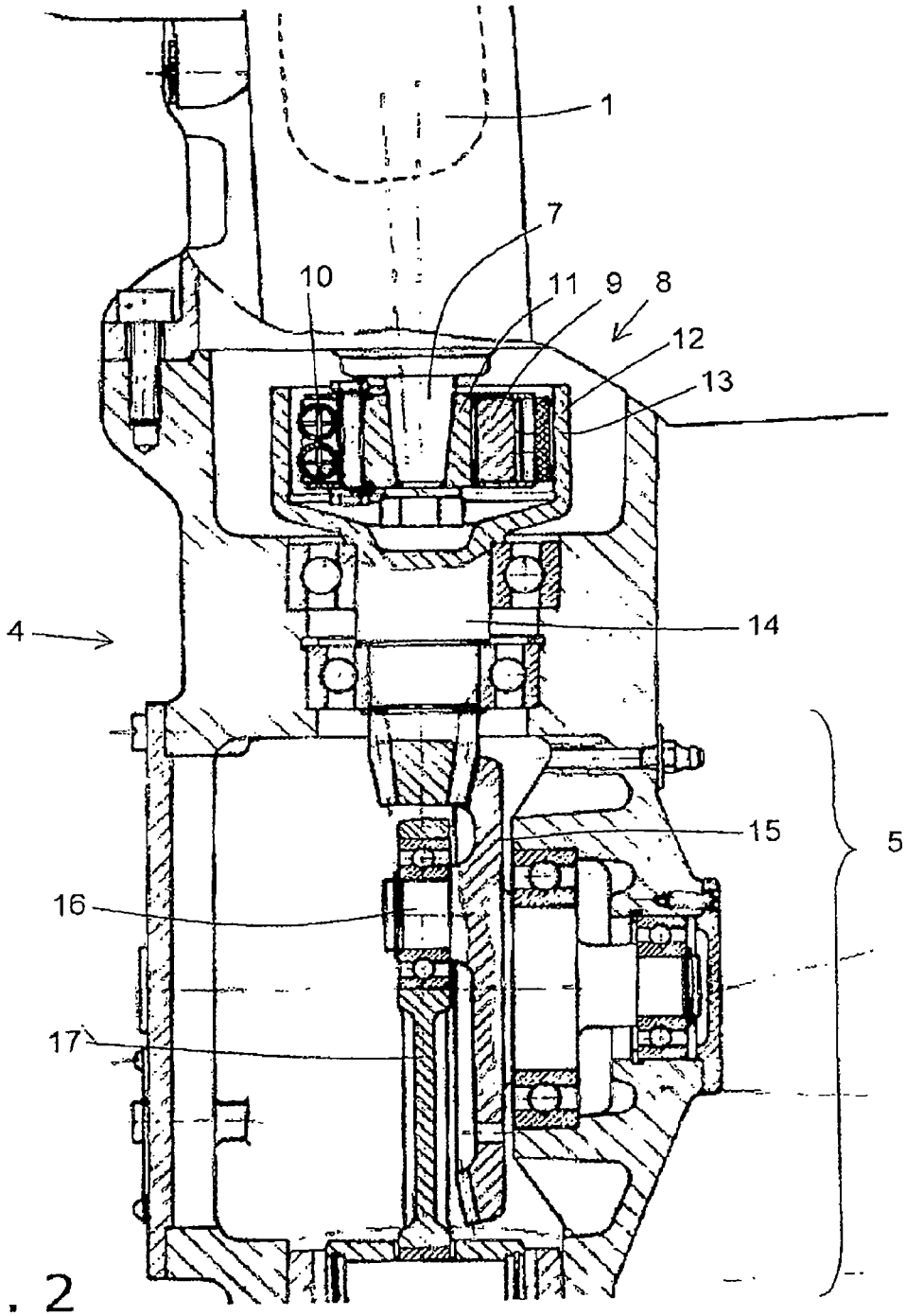
Fig. 2 PRIOR ART
FIG. 2 shows a partial section of the known tamper shown in FIG. 1.
Figure 3:
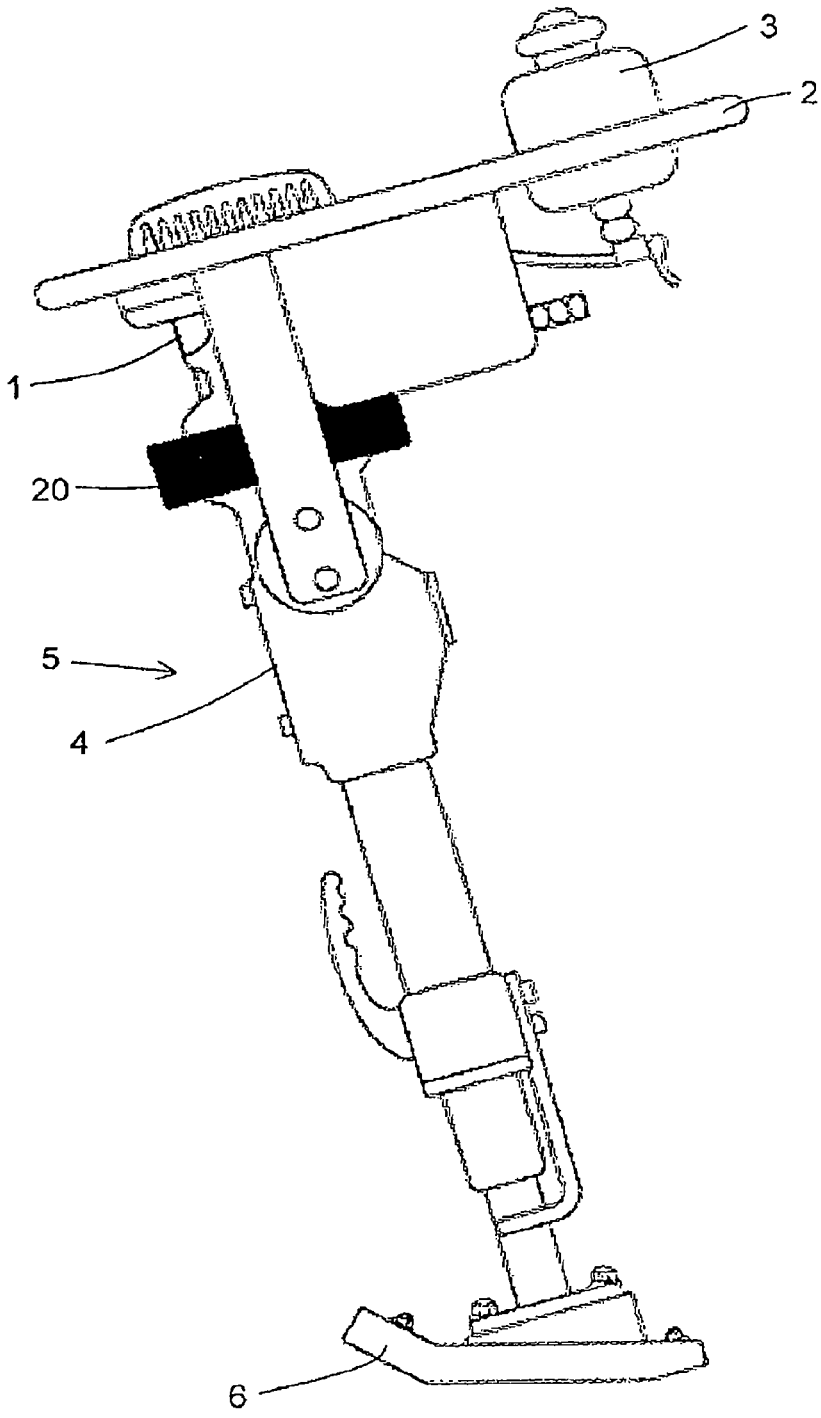
FIG. 3 shows a tamper as a soil compacting device according to the present invention, in a side view.

FIG. 3 shows an embodiment according to the present invention of the known soil compacting tamper described on the basis of FIGS. 1 and 2. Accordingly, reference is made to the above description relating to FIGS. 1 and 2. As far as possible, identical elements are not again described in detail. Only the differences from the tamper known from the prior art are explained in the following.

While the tamper described on the basis of FIG. 1 uses only internal combustion engine 1 as a drive, in the tamper shown in FIG. 3 an electric motor 20 is additionally provided. Depending on the wish of the operator, or when possible, it is possible to switch back and forth between a drive using internal combustion engine 1 or using electric motor 20. If, for example, a mains connection is available in the vicinity of the work location, low-emission electric motor 20 can be used, while internal combustion engine 1 is switched off. In outdoor areas, where as a rule no electrical network is available, the tamper is driven by internal combustion engine 1, while electric motor 20 does not function.

Figure 4:
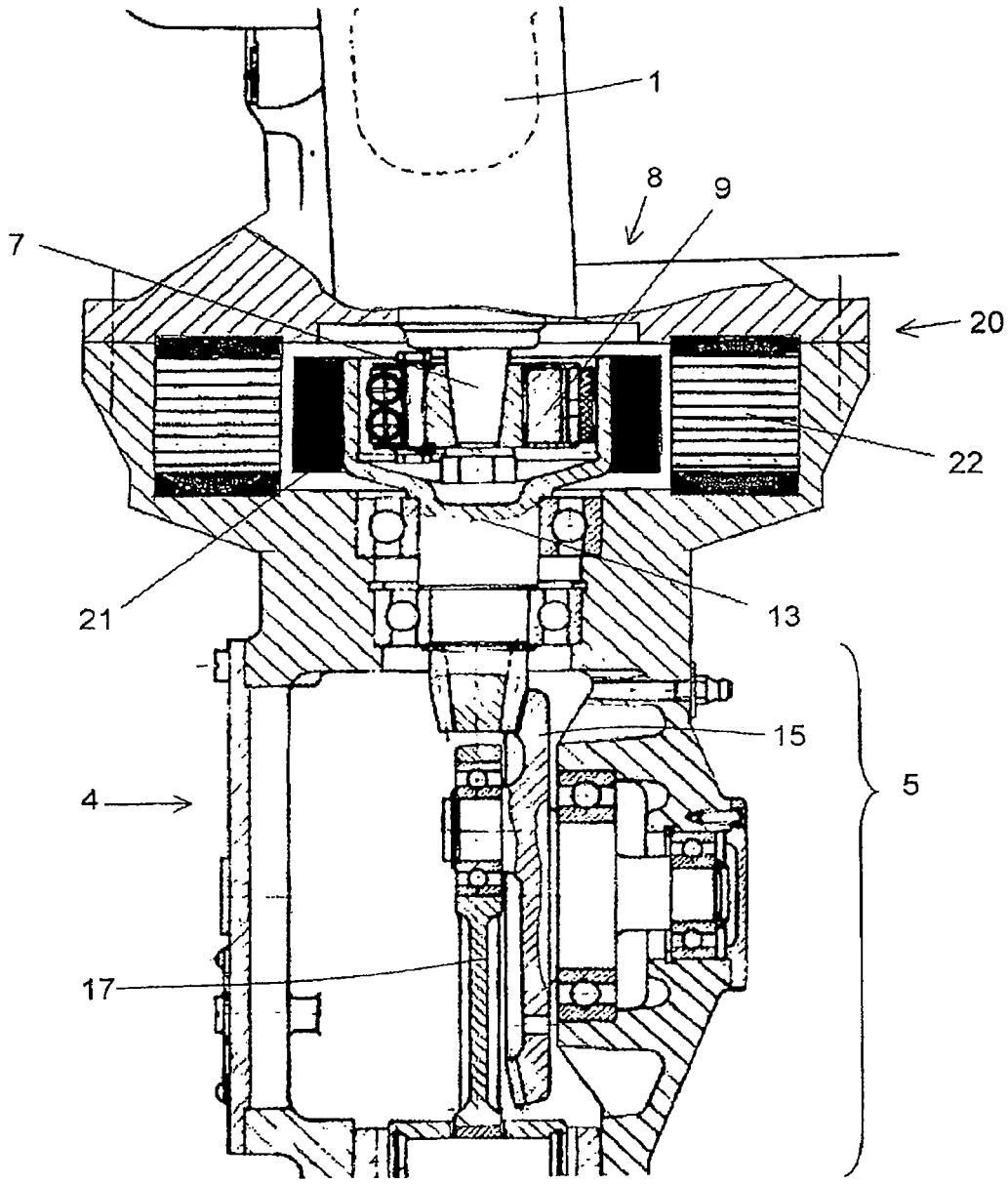
FIG. 4 shows a partial sectional view of the tamper shown in FIG. 3.

FIG. 4 shows a section through housing 4, comparable to the section shown in FIG. 2.

Here it can be seen that electric motor 20 is situated in the area of centrifugal clutch 8.

For this purpose, a rotor 21 of electric motor 20 is situated on the outer circumference of clutch bell 13. Situated opposite on the circumference, a stator 22 of electric motor 20 is placed in housing 4.

Rotor 21 can for example be formed by magnets that are set into rotation by corresponding driving of the coils of stator 22.

Because rotor 21 is situated directly on clutch bell 13, which forms driven bank 12, the rotational movement produced by electric motor 20 is transmitted to tamper foot 6 easily and in the same manner as in internal combustion engine 1, via movement conversion device 5, in particular via crank disk 15 and connecting rod 17.

Centrifugal clutch 8 ensures here that electric motor 20 does not also still have to drive engine shaft 7 of the internal combustion engine.

Due to the fact that electric motor 20 is integrated directly onto centrifugal clutch 8 on the one hand and into housing 4 on the other hand, electric motor 20 can be installed with minimum modification of the known tamper.

The invention claimed is:

1. A soil compacting device, comprising:

an internal combustion engine;

a soil contact element;

a movement conversion device for converting a rotational movement of the internal combustion engine into an oscillating linear movement of the soil contact element;

a clutch device for connecting and interrupting the flow of force between the internal combustion engine and the movement conversion device; and an electric motor that has a rotor and a stator; wherein the movement conversion device can optionally be driven by the internal combustion engine or by the electric motor.

2. The soil compacting device as recited in claim 1, wherein the clutch device has a drive bank coupled to the internal combustion engine, a driven bank coupled to the movement conversion device, and at least one clutch element that acts between the drive bank and the driven bank; and wherein the rotor is coupled to the driven bank of the clutch device.

3. A soil compacting device, comprising:

an internal combustion engine;

a soil contact element;

a movement conversion device for converting a rotational movement of the internal combustion engine into an oscillating linear movement of the soil contact element;

a clutch device for connecting and interrupting the flow of force between the internal combustion engine and the movement conversion device;

an electric motor that has a rotor and a stator; wherein the movement conversion device can optionally be driven by the internal combustion engine or by the electric motor; wherein the rotor forms a constructive unit together with a driven bank of the clutch device.

4. The soil compacting device as recited in claim 1, wherein:

a toothing is fashioned on a driven bank of the clutch device; and wherein the rotor is coupled to a pinion that meshes with the toothing of the driven bank.

5. The soil compacting device as recited in claim 1, wherein the clutch device is a centrifugal clutch device for connecting and interrupting the flow of force between the internal combustion engine and the movement conversion device as a function of a rotational speed of the internal combustion engine.

6. The soil compacting device as recited in claim 1, wherein the clutch element is a centrifugal element.

7. The soil compacting device as recited in claim 1, wherein a drive bank is coupled to an engine shaft of the internal combustion engine.

8. The soil compacting device as recited in claim 1, wherein:

a driven bank is fashioned as a clutch bell; and wherein the rotor is fashioned on the outer circumference of the clutch bell.

9. The soil compacting device as recited in claim 1, wherein the stator is provided in a housing that surrounds the clutch device.

10. The soil compacting device as recited in claim 1, wherein:

the movement conversion device has a toothing; and wherein the electric motor has a pinion that meshes with the toothing of the movement conversion device.

11. The soil compacting device as recited in claim 1, wherein:

the soil compacting device is a tamper for soil compacting;

the movement conversion device has a crank drive; and wherein the soil contact element is a tamper foot.

12. The soil compacting device as recited in claim 1, further comprising a changeover device for changing over between driving by the internal combustion engine and driving by the electric motor.

13. The soil compacting device as recited in claim 1, further comprising:

an energy storage device for storing electrical energy; and wherein the electric motor can be supplied by the electrical energy from at least one of the energy storage device and via a mains cable.

14. A soil compacting device, comprising:

an internal combustion engine;

an electric motor having a rotor and a stator;

a soil contact element;

a movement conversion device that converts a rotational movement of at least one of the internal combustion engine and the electric motor into an oscillating linear movement of the soil contact element; and a clutch device that selectively connects and interrupts a flow of force between the internal combustion engine and the movement conversion device, the clutch device interrupting the flow of force between the internal combustion engine and the movement conversion device when the electric motor is supplying power to the movement conversion device.

15. A soil compacting device comprising:

an internal combustion engine;

an electric motor having a rotor and a stator;

a soil contact element;

a movement conversion device that converts a rotational movement of at least one of the internal combustion engine and the electric motor into an oscillating linear movement of the soil contact element;

a clutch device that selectively connects and interrupts a flow of force between the internal combustion engine and the movement conversion device; wherein the clutch includes a drive bank that is connected to the internal combustion engine and a driven bank that is connected to the movement conversion device, and wherein the rotor of the electric motor is coupled to the driven bank of the clutch device.

16. A method of operating a soil compacting device, the soil compacting device comprising a soil contact element, a movement conversion device coupled to the soil contact element, a clutch device, an internal combustion engine, and an electric motor, the method comprising:

driving an input of the movement conversion device to rotate using at least one of the electric motor and the internal combustion engine;

using the movement conversion device, driving the soil contact element to oscillate linearly;

engaging a clutch to couple the internal combustion engine to the input of the movement conversion device whenever the movement conversion device is to driven by the internal combustion engine; and disengaging the clutch to decouple the internal combustion engine from the input of the movement conversion device whenever the movement conversion device is driven by the electric motor.

17. The method as recited in claim 16, further comprising preventing driving of the input element of the movement conversion device by the electric motor when the movement conversion device is to driven by the internal combustion engine.

18. The method as recited in claim 16, wherein the driving step is performed using only a selected one of the internal combustion engine and the electric motor.

* * * * *